United States Patent [19]

Saito et al.

[11] Patent Number: 4,624,232

[45] Date of Patent: Nov. 25, 1986

[54] APPARATUS FOR CONTROLLING AIR-FUEL RATIO IN INTERNAL COMBUSTION ENGINE

[75] Inventors: Kimitaka Saito; Kenzi Iwamoto, both of Nishio; Hideki Obayashi, Okazaki; Takeshi Matuyama, Nukata, all of Japan

[73] Assignee: Nippon Soken, Inc., Nishio, Japan

[21] Appl. No.: 757,846

[22] Filed: Jul. 22, 1985

[30] Foreign Application Priority Data

Jul. 23, 1984 [JP] Japan ..... 59-153789

[51] Int. Cl.[4] ..... F02M 51/00

[52] U.S. Cl. ..... 123/489; 123/440; 123/480; 123/486

[58] Field of Search ..... 123/489, 480, 440, 486; 73/23

[56] References Cited

U.S. PATENT DOCUMENTS

| | | | |
|---|---|---|---|
| 4,121,548 | 10/1978 | Hattori et al. | 123/489 |
| 4,177,787 | 12/1979 | Hattori et al. | 123/489 |
| 4,344,317 | 8/1982 | Hattori et al. | 123/440 |
| 4,502,444 | 3/1985 | Rubbo et al. | 123/489 |
| 4,509,489 | 4/1985 | Hasegawa et al. | 123/489 |
| 4,517,948 | 5/1985 | Kaji et al. | 123/489 |
| 4,528,957 | 7/1985 | Jundt et al. | 123/489 |
| 4,542,729 | 9/1985 | Yamato et al. | 123/489 |

*Primary Examiner*—Raymond A. Nelli

*Attorney, Agent, or Firm*—Cushman, Darby & Cushman

[57] ABSTRACT

In an apparatus for the feedback control of the air-fuel ratio in an internal combustion engine using the output signal of an air-fuel ratio sensor, a degree of deterioration of the functioning of the air-fuel ratio sensor is detected by using successive measurements of a differential waveform of an output signal of the air-fuel ratio sensor over a predetermined period of time, and an air-fuel ratio feedback control constant is controlled in accordance with the degree of functional deterioration of the air-fuel ratio sensor to correct the air-fuel ratio.

21 Claims, 42 Drawing Figures

FAF ROUTINE
1201
F/B ?
NO
YES
FETCH OX
1202
1203
OX ≧ RL ?
NO(LEAN)
YES (RICH)
TDL ← 0
1204
TDR ←TDR + 1
1205
1206
TDR > DR ?
NO
YES
1207
F = "0" ?
NO
YES
FAF← FAF-SL
1208
FAF ← FAF-KL
1210
F ← "1"
1209
RETURN
1219

| |
|---|
| Fig.17A |
| Fig.17B |

APPARATUS FOR CONTROLLING AIR-FUEL RATIO IN INTERNAL COMBUSTION ENGINE

BACKGROUND OF THE INVENTION (1) Field of the Invention

The present invention relates to an apparatus for feedback control of the air-fuel ratio in an internal combustion engine.

(2) Description of the Related Art

Generally, in an air-fuel ratio feedback control system of an internal combustion engine, a base fuel amount is calculated in accordance with the intake air amount (or the intake air pressure) and the engine speed, and is corrected by using an air-fuel ratio correction amount calculated in accordance with a detection signal of an air-fuel ratio sensor (so-called $0_2$ sensor) which detects the concentration of a specific component, such as oxygen, in the exhaust gas. Thus, the corrected fuel amount determines an actual fuel amount to be supplied to the engine. The above-mentioned steps are repeated to control the center value of the controlled air-fuel ratio within a very narrow range around the stoichimetric ratio required for three-way reducing and oxidizing catalysts.

In the prior art, when the condition of the air-fuel ratio sensor is completely deteriorated and it no longer functions correctly, the feedback control of the air-fuel ratio is stopped and an alarm is generated.

Recently, engines with a high fuel efficiency and a low friction coefficient have been developed. In such engines, the temperature of the exhaust gas may be reduced, thus cooling the air-fuel ratio sensor. In this case, when the condition of the air-fuel ratio sensor is completely deteriorated and it no longer functions correctly, the feedback control of the air-fuel ratio is stopped. However, when the condition of the air-fuel ratio sensor is not fully deteriorated, as a result of individual differences in and aging thereof, the air-fuel ratio sensor still exhibits a partial functioning. As a result, the feedback control of the air-fuel ratio may be carried out in such a manner that the controlled center of the air-fuel ratio often deviates from an optimum value, thus increasing the exhaust emission such as $NO_x$, reducing the drivability, and reducing the fuel efficiency.

SUMMARY OF THE INVENTION

It is an object of the present invention to provide an apparatus for controlling the air-fuel ratio in an internal combustion engine which can improve the exhaust emission such as $NO_x$, the drivability, and the fuel efficiency, even when the air-fuel ratio sensor is not fully functional.

According to the present invention, a degree of deterioration in the functioning of the air-fuel ratio sensor is detected by using the output signal of the air-fuel ratio sensor, and an air-fuel ratio feedback control constant is controlled in accordance with the detected degree of deterioration of the functioning of the air-fuel ratio sensor to correct the air-fuel ratio. As a result, even when the air-fuel ratio sensor is still partly functional due to individual differences and aging thereof and is subjected to the cooled exhaust gas, the air-fuel ratio feedback control is carried out by correcting the air-fuel ratio, thus obtaining an optimum air-fuel ratio, i.e., the stoichimetric air-fuel ratio.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
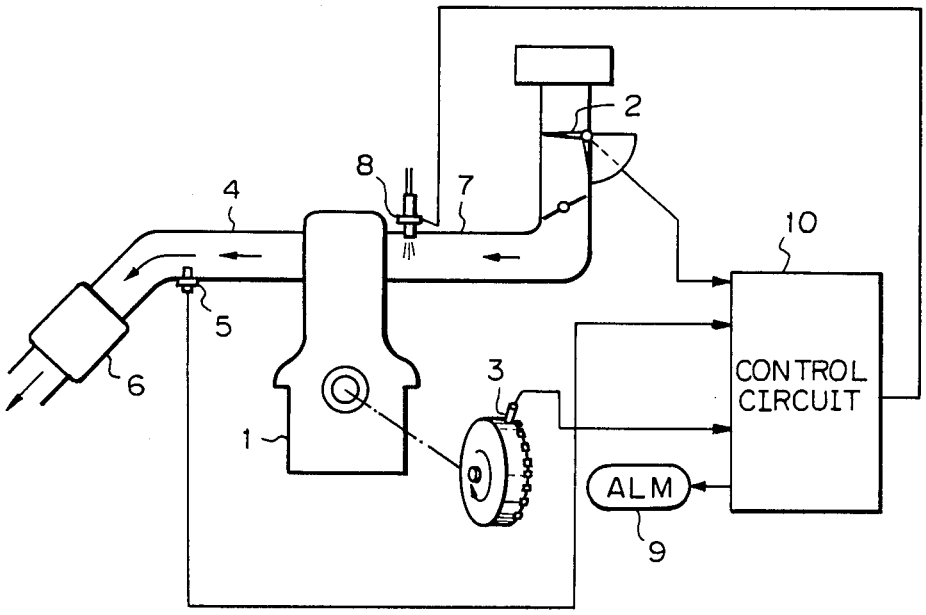
FIG. 1 is a schematic diagram of an internal combustion engine according to the present invention.

In FIG. 1, which illustrates an internal combustion engine according to the present invention, reference numeral 1 designates a six-cylinder spark-ignition type engine; 2 an airflow meter for detecting the air amount sucked into the engine 1; 3 a rotational speed sensor for detecting the rotational speed of the engine 1; 4 an exhaust pipe; 5 an air-fuel ratio sensor; 6 a three-way reducing and oxidizing catalyst; 7 an air intake pipe; 8 a solenoid fuel injection valve provided at the air intake pipe 7; 9 an alarm; and 10 a control circuit for calculating the amount of the fuel to be supplied to the engine 1 and supplying to the fuel injection valve 8 the actuating signal which is based on the calculated fuel amount to the fuel injection valve 8.

In a steady running state of the engine 1, the control circuit 10 calculates the base fuel injection amount on the basis of signals from the airflow meter 2, the rotational speed sensor 3, and the like; calculates the air-fuel ratio feedback correction amount on the basis of the signal from the air-fuel ratio sensor 5 to correct the base fuel amount by this correction value; and delivers the signal commanding the opening period of the fuel injection valve 8.

Figure 2:
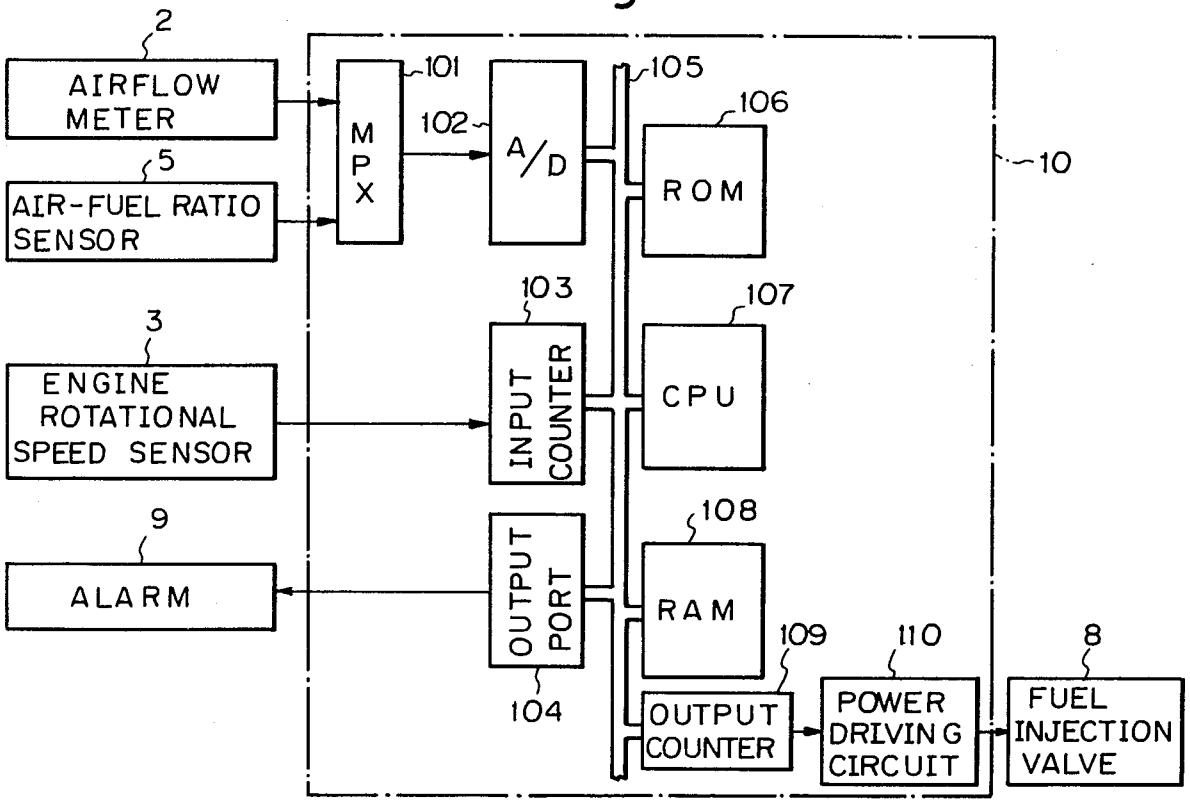
FIG. 2 is a circuit diagram of the control circuit of FIG. 1.

In FIG. 2, which is a detailed block circuit diagram of the control circuit 10 of FIG. 1, the control circuit 10 has a multiplexer 101 for receiving signals from the airflow meter 2 and the air-fuel ratio sensor 5; an analog-to-digital (A/D) converter 102; an input counter 103 for receiving a signal from the engine rotational speed sensor 3; and an output port 104 for activating the alarm 9. In addition, the control circuit 10 comprises a bus 105, a read-only memory (ROM) 106, a central processing unit (CPU) 107, a random-access memory (RAM) 108, an output counter 109, and a power driving circuit 110. The output signal of the power driving circuit 110 is supplied to the fuel injection valve 8.

Figure 3:
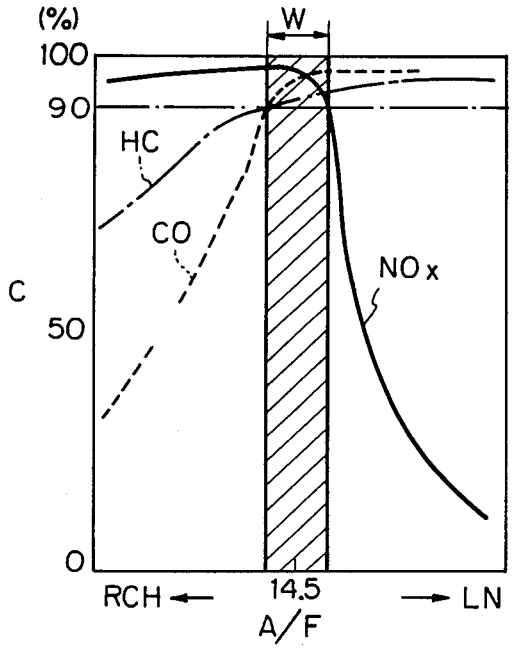
FIG. 3 is a graph showing the cleaning rate characteristics of the three-way catalyst of FIG. 1.

The cleaning rate characteristics of the three-way catalyst 6 of FIG. 1 will be explained with reference to FIG. 3. In FIG. 3, the ordinate C represents the catalytic cleaning rate while the abscissa A/F represents the air-fuel ratio of the exhaust gas. That is, when the air-fuel ratio A/F is on the lean side LN, the cleaning rate C of the $NO_x$ emission is reduced. Contrary to this, when the air-fuel ratio A/F is on the rich side RCH, the cleaning rate C of the HC and CO emissions is reduced. Therefore, from the view point of obtaining an optimum cleaning rate by the reducing and oxidizing catalyst, it is preferable that the air-fuel ratio be controlled to lie within a narrow window W, thus obtaining a cleaning rate of more than 90% for each emission. That is, the above-mentioned air-fuel ratio feedback control is carried out by determining whether or not the output signal of the air-fuel ratio is larger than a value corresponding to the stoichimetric ratio (A/F=14.5), so that the air-fuel ratio is controlled to be within the narrow window W. Thus, the controlled air-fuel ratio is affected by the functional deterioration of the air-fuel ratio sensor.

Figure 4:
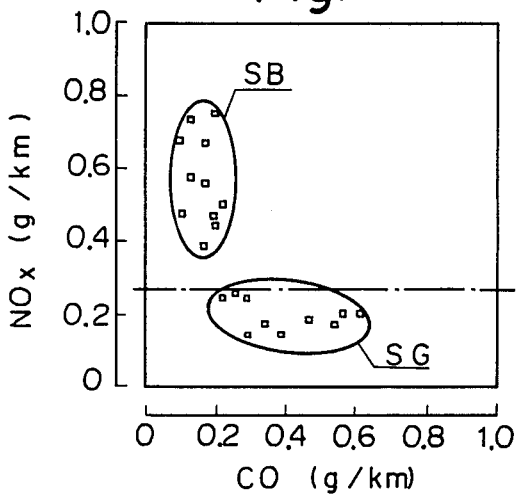
FIG. 4 is a graph showing the emission characteristics of the engine.

For example, when the air-fuel ratio sensor 5 is fully functional, the $NO_x$ emission amount is small as indicated by SG of FIG. 4, and when the functioning of the air-fuel ratio sensor 5 is deteriorated, the $NO_x$ emission amount is large as indicated by SB of FIG. 4. That is , when the functioning of the air-fuel ratio sensor 5 is deteriorated, and in addition, the air-fuel ratio feedback control is carried out, the $NO_x$ emission amount exceeds an allowed limit as indicated by a dash-dot line in FIG. 4. Note that the running condition shown in FIGS. 3 and 4 is based on the 10-mode.

According to the present invention, a degree of functional deterioration of the air-fuel ratio sensor 5 is detected, and an air-fuel ratio feedback control constant is controlled in accordance with the degree of functional deterioration of the air-fuel ratio sensor 5. In this case, the air-fuel ratio feedback control is not stopped.

Figure 5:
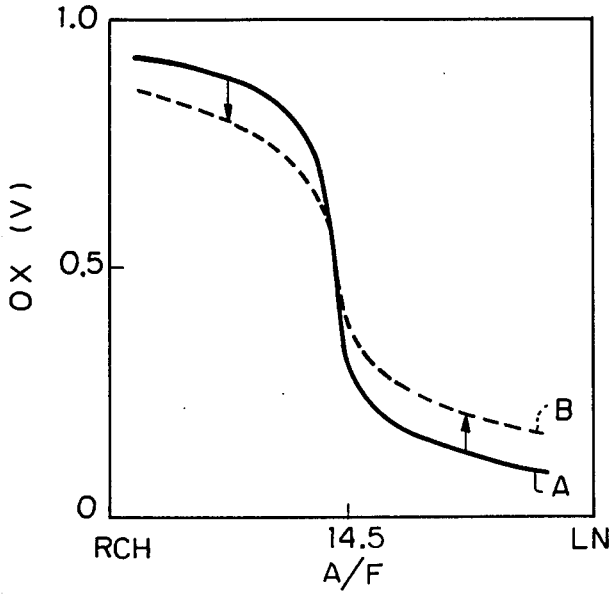
FIG. 5 is a graph showing static characteristics of the output signal of the air-fuel ratio sensor.
Figure 6:
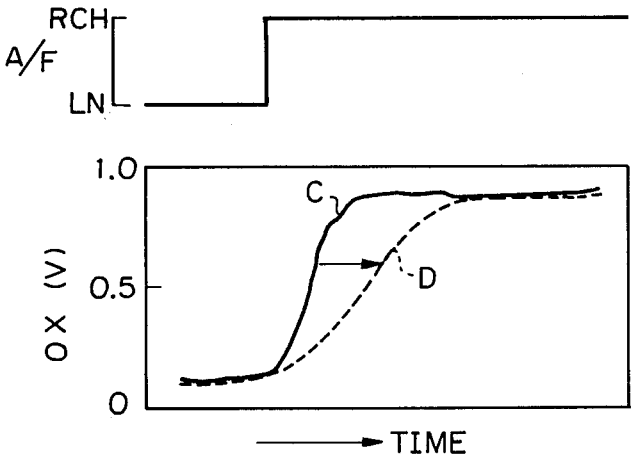
FIG. 6 is a timing diagram showing dynamic characteristics of the output signal of the air-fuel ratio sensor.

The phenomenon of functional deterioration of the air-fuel ratio sensor 5 will be explained with reference to FIGS. 5 and 6, which show the static and dynamic characteristics of the output signal of the air-fuel ratio sensor 5 respectively. In FIG. 5, when the functioning of the air-fuel ratio sensor 5 is deteriorated, the characteristic of the output voltage OX of the air-fuel ratio sensor 5 is changed from A to B. This means that the sensibility of the air-fuel ratio sensor 5 is reduced, when deteriorated. In FIG. 6, when the air-fuel ratio of the exhaust gas is changed stepwise from the lean side LN to the rich side RCH, the output voltage OX of the air-fuel ratio sensor 5 is changed as indicated by C, if there is no deterioration of the sensor 5. Contrary to this, the output voltage OX of the air-fuel ratio sensor 5 is changed as indicated by D, if the sensor 5 is deteriorated. This means that the response speed of the air-fuel ratio sensor 5 is reduced, if the sensor 5 is deteriorated.

Figure 7:
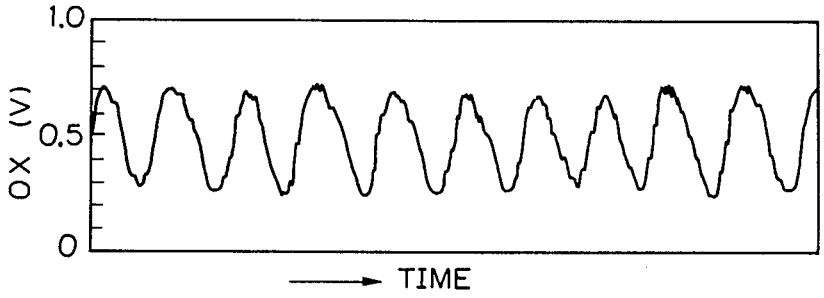
FIG. 7 is a timing diagram showing an example of the output signal of the air-fuel ratio sensor.
Figure 8:
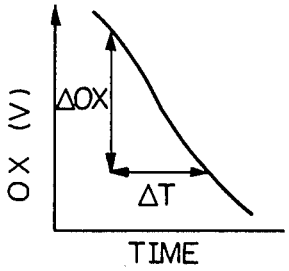
FIG. 8 is a graph showing the slope of the output signal of the air-fuel ratio sensor.

Accordingly to the present invention, both the static and dynamic deterioration characteristics of the air-fuel ratio sensor 5 can be detected. Referring to FIG. 7 which shows an example of the output voltage OX of the air-fuel ratio sensor 5 and FIG. 8 which is an enlargement of a part of FIG. 7, the differential value (slope) of OX is defined by $$\frac{\Delta OX}{\Delta T}.$$

If the static characteristics of the air-fuel ratio sensor 5 are reduced, the value ΔOX is decreased. Contrary to this, if the dynamic characteristics of the air-fuel ratio sensor 5 are reduced, the value ΔT is increased. Therefore, even if only one of the static and dynamic characteristics of the air-fuel ratio sensor 5 is reduced, the differential value ΔOX/ΔT is decreased.

Figure 9:
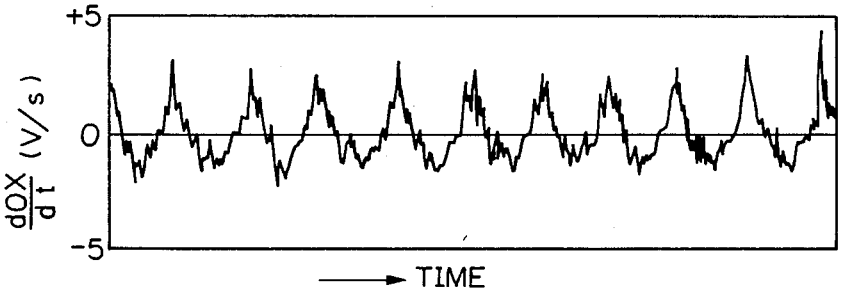
FIG. 9 is a timing diagram showing the differential waveform of the output signal of the air-fuel ratio sensor.

The differential waveform of the output voltage OX of the air-fuel ratio sensor 5 of FIG. 7 is shown in FIG. 9. The differential waveform can be divided into positive portions and negative portions. In this case, each positive differential portion shows the slope amount of the output voltage OX of the air-fuel ratio sensor 5 from the lean side LN to the rich side RCH. Thus, a positive differential portion is called a rich slope. Contrary to this, each negative differential portion shows the slope amount of the output voltage OX of the air-fuel ratio sensor 5 from the rich side RCH to the lean side LN. Thus, a negative differential portion is called a lean slope.

Figure 10A:
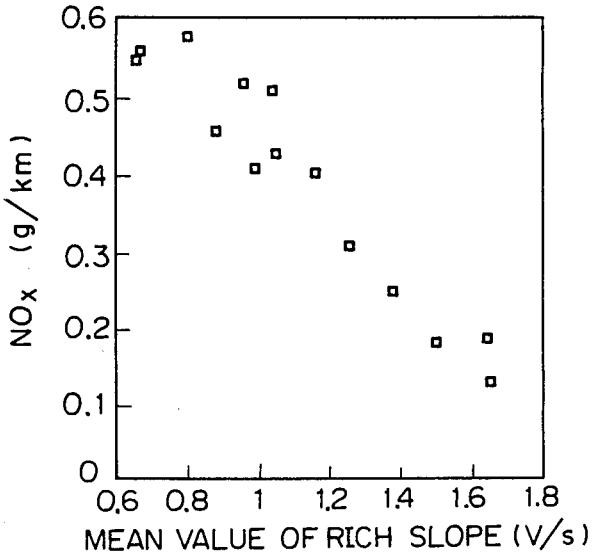
FIGS. 10A, 10B, 11A, 11B, 12A, and 12B are graphs showing the $NO_x$ emission characteristics with respect to the differential waveform of the output signal of the air-fuel ratio sensor.
Figure 10B:
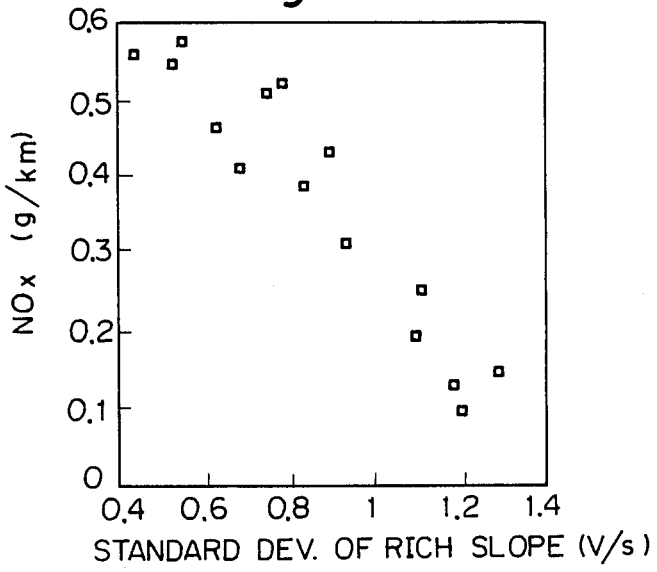
Figure 11A:
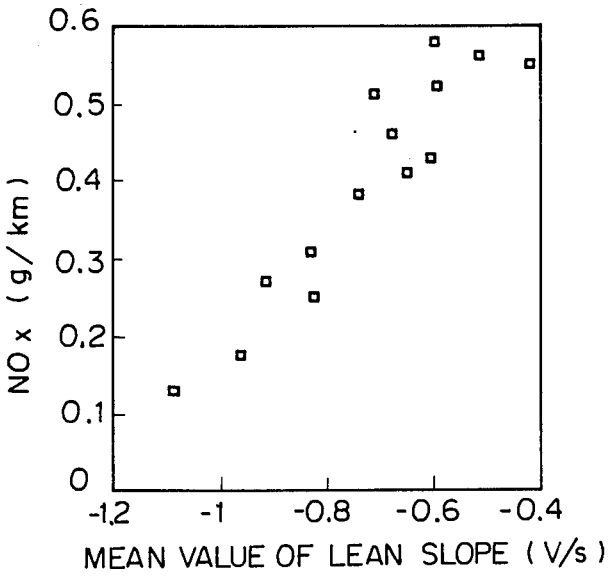
Figure 11B:
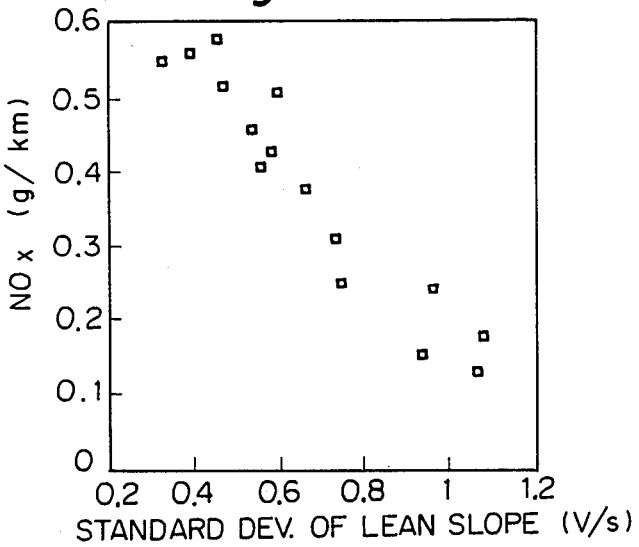
Figure 12A:
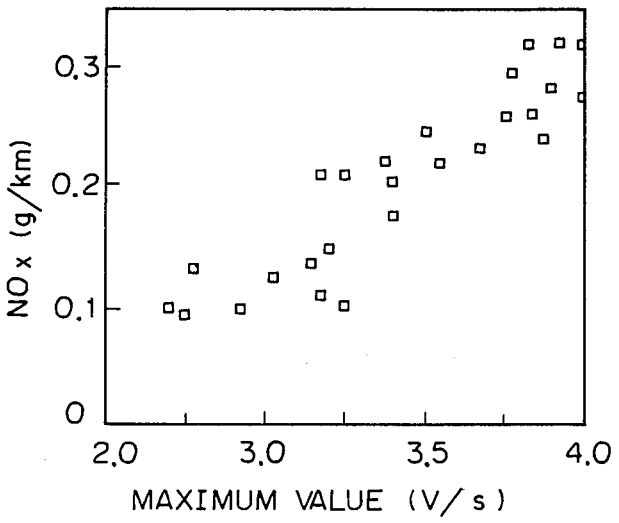
Figure 12B:
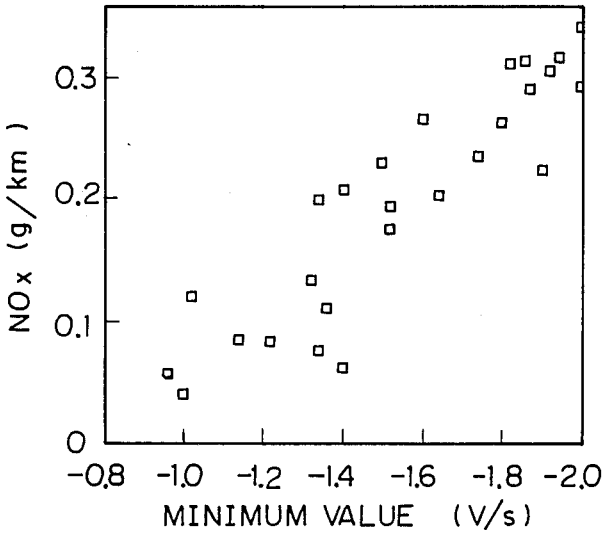

The mean value and standard deviation of each rich slope can be calculated from the differential waveform as shown in FIG. 9. The relationship between the mean value of the rich slope and the $NO_x$ emission is shown in FIG. 10A, and the relationship between the standard deviation of the rich slope and the $NO_x$ emission is shown in FIG. 10B. Similarly, the mean value and standard deviation of each lean slope can be calculated from the differential waveform as shown in FIG. 9. The relationship between the mean value of the lean slope and the $NO_x$ emission is shown in FIG. llA, and the relationship between the standard deviation of the lean slope and the $NO_x$ emission is shown in FIG. 11B. Further, the maximum value and minimum value of the differential waveform can be calculated from the differential waveform as shown in FIG. 9. The relationship between the maximum value and the $NO_x$ emission is shown in FIG. 12A, and the relationship between the minimum value and the $NO_x$ emission is shown in FIG. 12B. As shown in FIGS. 10A, 10B, llA, llB, 12A, and 12B, the means value and standard deviation of a rich slope or a lean slope, the maximum value and the minimum value have a strong relationship to the $NO_x$ emission. In view of this, according to the present invention, the degree of functional deterioration of the air-fuel ratio sensor 5 is detected by using the differential waveform of the output signal OX thereof. In addition, a control constant for the feedback control is changed in accordance with the degree of functional deterioration of the air-fuel ratio sensor 5, to correct the controlled air-fuel ratio, thus obtaining an excellent cleaning performance by the three-way catalyst 6.

The air-fuel ratio feedback control will be explained with reference to FIGS. 13, and 14A through 14E.

Figures 13, 13A, 13B:
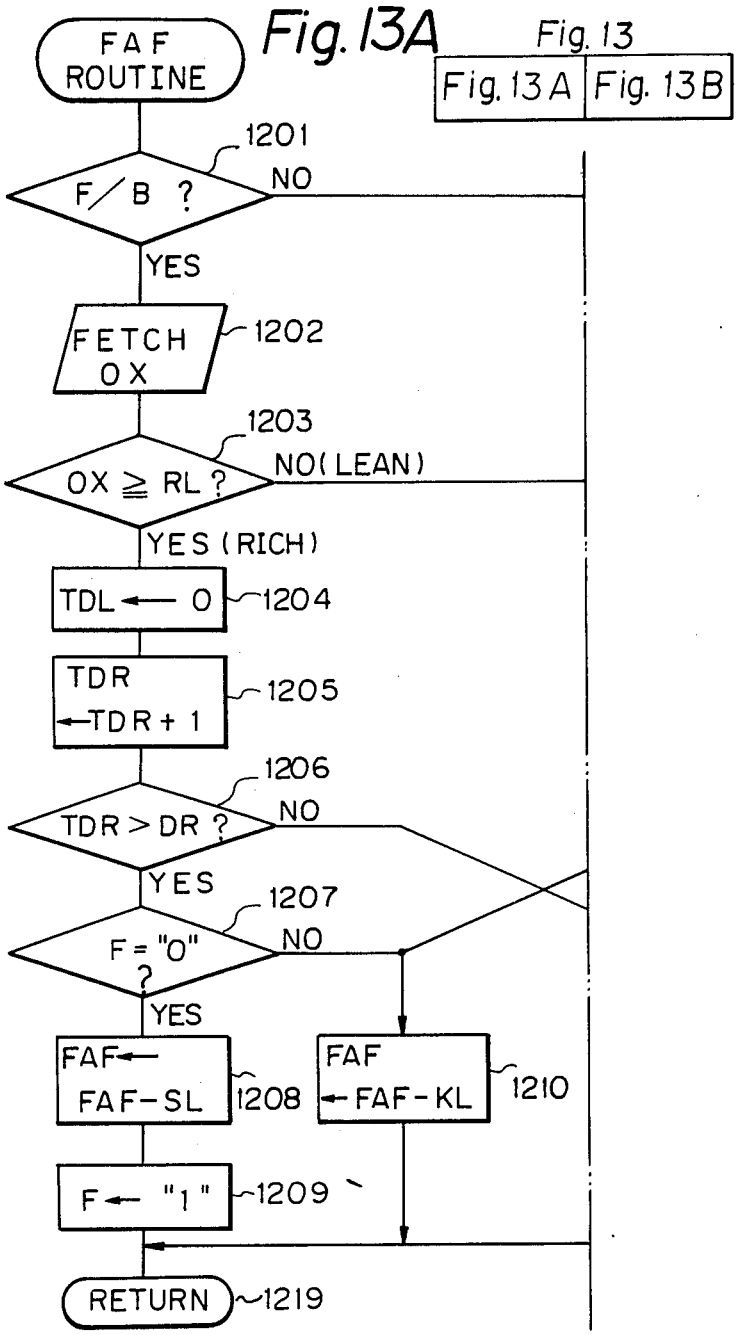
FIGS. 13, 13*a*, 13*b*, 16, 17, 17*a*, 17B, 18A, 18B, 18C, 18D, 18E, 19A, 19B, 19C, 19D, 19E, and 19F are flowcharts showing the operation of the control circuit of FIG. 1.
Figure 13B:
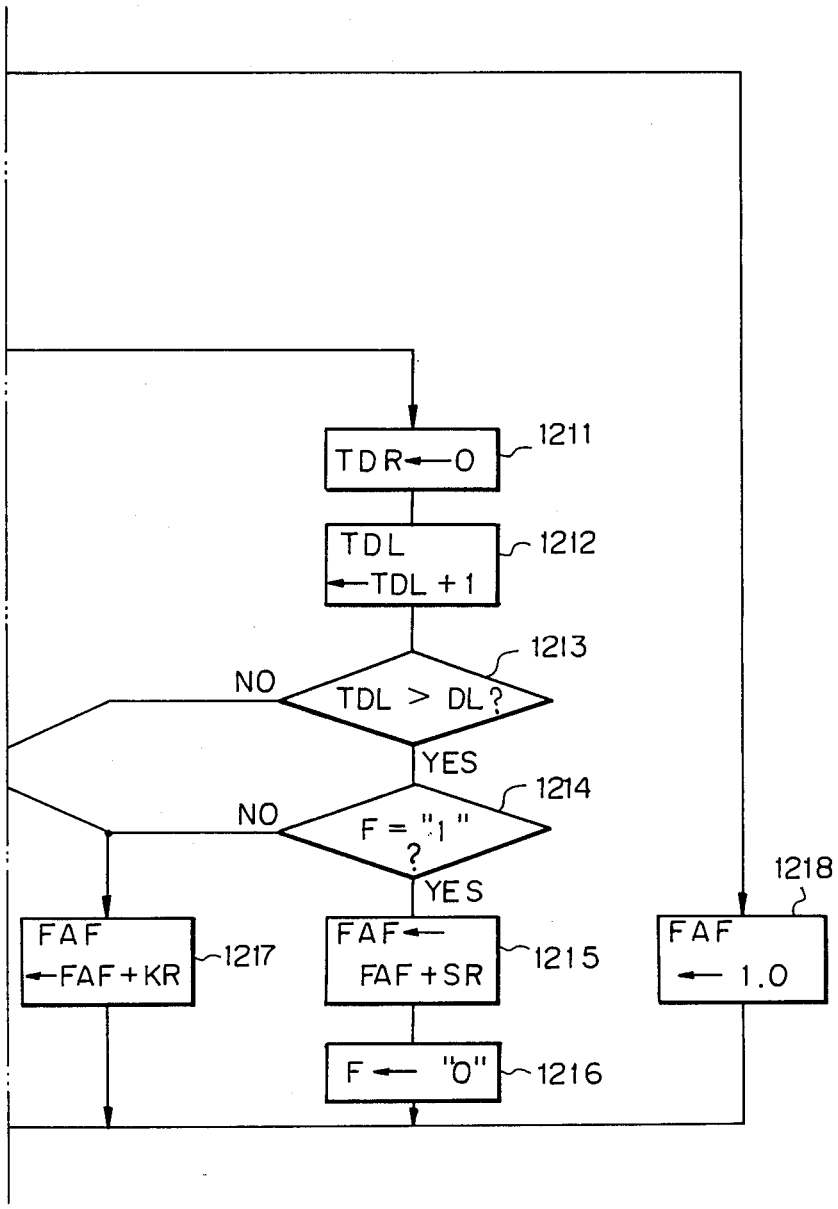

FIG. 13 is a routine for calculating an air-fuel ratio feedback correction amount FAF executed at every predetermined time period.

At step 1201, it is determined whether or not all the feedback control (closed-loop control) conditions are satisfied. The feedback control conditions are as follows:

(i) the engine is not in a starting state;

(ii) the coolant temperature is higher than a definite value; and (iii) the power fuel increment is 0.

Of course, other feedback control conditions are introduced as occasion demands. However, an explanation of such other feedback control conditions is omitted.

If one or more of the feedback control conditions is not satisfied, the control proceeds to step 1218, in which the coefficient FAF is caused to be 1.0 (FAF=1.0), thereby carrying out an open-loop control operation. Contrary to this, if all the feedback control conditions are satisfied, the control proceeds to step 1202.

At step 1202, the output voltage OX of the air-fuel ratio sensor 5 is fetched from the A/D converter 102. Then, at step 1203, the output voltage OX is compared with a reference voltage RL, thereby determining whether or not the current air-fuel ratio is rich or lean with respect to the stoichimetic ratio. If OX≧RL so that the current air-fuel ratio is rich, the control proceeds to step 1204, in which a lean delay counter TDL is cleared, and further proceeds to step 1205, in which a rich delay counter TDR is counted up by 1. Note that the lean delay counter TDL and the rich delay counter TDR are used for a delay process for delaying the determination result at step 1203.

At step 1206, it is determined whether or not the rich delay counter TDR is larger than a rich delay time period DR. As a result, if TDR≦DR, the control proceeds to step 1217 which increases the air-fuel feedback correction amount FAF by a relatively small rich integration amount KR. If TDR>DR, the control proceeds to step 1207.

At step 1207, it is determined whether or not a skip flag is "0". Note that the skip flag F (="0") is used for a skip operation when a first change from lean to rich occurs in the controlled air-fuel ratio. As a result, if the skip flag F is "0", the control proceeds to step 1208, which decreases the amount FAF by a relatively large lean skip amount SL. Then, at step 1209, the skip flag F is set, i.e., F←"1". Thus, when the control at step 1207 is further carried out, then the control proceeds to step 1210, which decreases the amount FAF by a relatively small lean integration amount KL. Here, SL is a constant for a skip operation which remarkably decreases the amount FAF when a first change from lean (OX° RL) to rich (OX>RL) occurs in the controlled air-fuel ratio, while KL is a constant for an integration operation which gradually decreases the amount FAF when the controlled air-fuel ratio is rich.

On the other hand, at step 1203, if OX<RL so that the current air-fuel ratio is lean, the control proceeds to step 1211, in which the rich delay counter TDR is cleared, and further proceeds to step 1212, in which the lean delay counter TDL is counted up by 1.

At step 1213, it is determined whether or not the lean delay counter TDL is larger than a lean delay time period DL. As a result, if TDL≦DL, the control proceeds to step 1210 which decreases the air-fuel feedback correction amount FAF by the relatively small lean integration amount KL. If TDL>DL, the control proceeds to step 1214.

At step 1214, it is determined whether or not the skip flag F is "1". Note that the skip flag F (="1") is used for a skip operation, when a first change from rich to lean occurs in the controlled air-fuel ratio. As a result, if the skip flag F is "1", the control proceeds to step 1215, which increases the amount FAF by a relatively large rich skip amount SR. Then at step 1216, the skip flag F is cleared, i.e., F←"0". Thus, when the control at step 1214 is further carried out, then the control proceeds to step 1217, which increases the amount FAF by a relatively small rich integration amount KR. Here, SR is a constant for a skip operation which remarkably increases the amount FAF when a first change from rich (OX≧RL) to lean (OX<RL) occurs in the controlled air-fuel ratio, while KR is a constant for an integration operation which gradually increases the amount FAF when the controlled air-fuel ratio is lean.

Then, the routine of FIG. 13 is completed by step 1219.

Figures 14A, 14B, 14C, 14D, 14E:
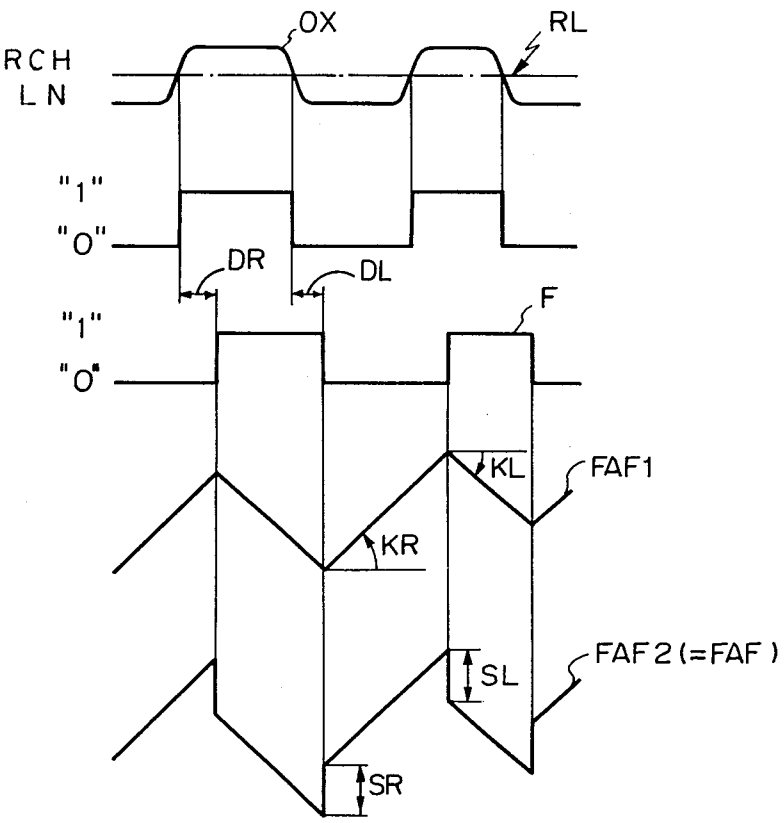
FIGS. 14A through 14E are timing diagrams for a supplemental explanation of the flowchart of FIG. 13.

The routine of FIG. 13 is further explained with reference to FIGS. 14A through 14E. That is, when the output voltage OX of the air-fuel ratio sensor 5 is changed as shown in FIG. 14A, the determination result at step 1203 is obtained as shown in FIG. 14B. Next, when a delay process at steps 1204, 1205 and 1206 (or 1211, 1212, and 1213) is performed upon the determination result of FIG. 14B, the delayed determination result is obtained as shown in FIG. 14C. Note that this delayed determination result of FIG. 14C corresponds to the skip flag F. An air-fuel ratio correction amount FAF is calculated on the basis of the delayed determination result F of FIG. 14C. In view of only an integration process as shown at steps 1210 and 1217, an air-fuel correction amount FAF1 is obtained as shown in FIG. 14D. Further, in view of a skip process as shown at steps 1208 and 1215 in addition to the integration process, an air-fuel correction amount FAF2 (=FAF) is obtained as shown in FIG. 14E.

As explained above, RL, DR, DL, KR, KL, SR, and SL are important parameters for calculating the air-fuel ratio feedback correction amount FAF, i.e., for determining the controlled air-fuel ratio in the feedback control.

Figure 15A:
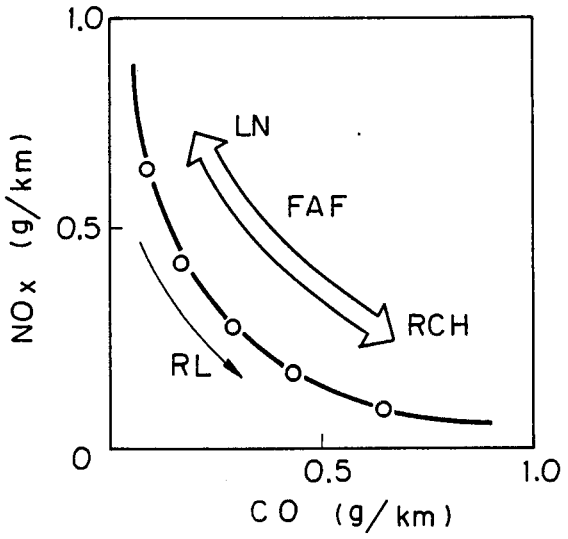
FIGS. 15A through 15D are graphs showing the emission characteristics with respect to the air-fuel ratio feedback control constants.

For example, as shown in FIG. 15A, if the reference voltage RL is decreased, the air-fuel ratio correction amount FAF is decreased so that the controlled air-fuel ratio A/F is moved to the lean side, thus increasing the $NO_x$ emission. Contrary to this, if the reference voltage RL is increased, the air-fuel ratio correction amount FAF is increased so that the controlled air-fuel ratio A/F is moved to the rich side, thus reducing the $NO_x$ emission.

Figure 15B:
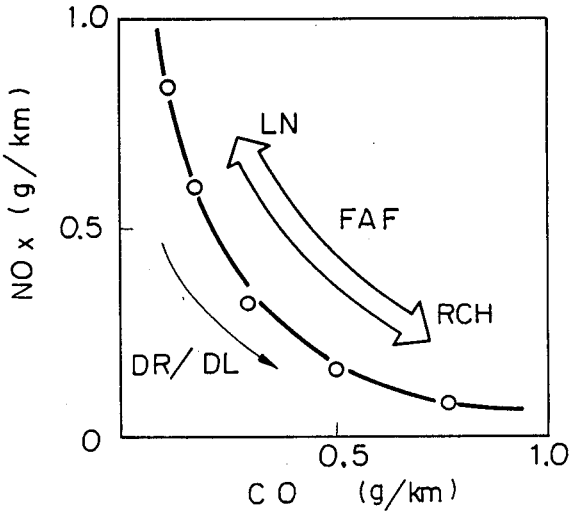

In addition, as shown in FIG. 15B, if the rich delay time period DR is decreased (if the lean delay time period DL is increased), the air-fuel ratio correction amount FAF is decreased so that the controlled air-fuel ratio A/F is moved to the lean side, thus increasing the $NO_x$ emission. Contrary to this, if the rich delay time period DR is increased (if the lean delay time period DL is decreased), the air-fuel ratio correction amount FAF is increased so that the controlled air-fuel ratio A/F is moved to the rich side, thus reducing the $NO_x$ emission.

Figure 15C:
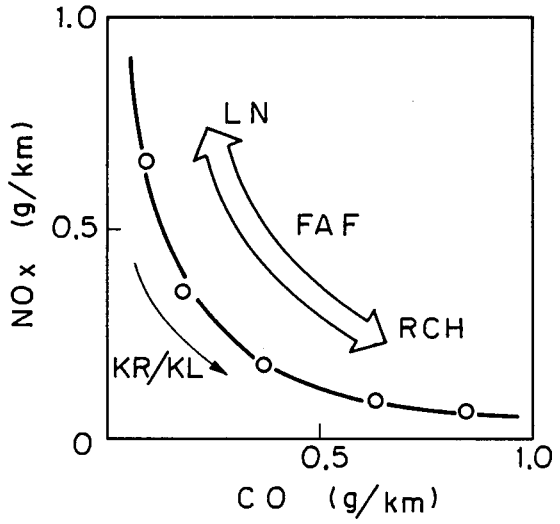

Further, as shown in FIG. 15C, if the rich integration amount KR is decreased (if the lean integration amount KL is increased), the air-fuel ratio correction amount FAF is decreased so that the controlled air-fuel ratio A/F is moved to the lean side, thus increasing the $NO_x$ emission. Contrary to this, if the rich integration amount KR is increased (if the lean integration amount KL is decreased), the air-fuel ratio correction amount FAF is increased so that the controlled air-fuel ratio A/F is moved to the rich side, thus reducing the $NO_x$ emission.

Figure 15D:
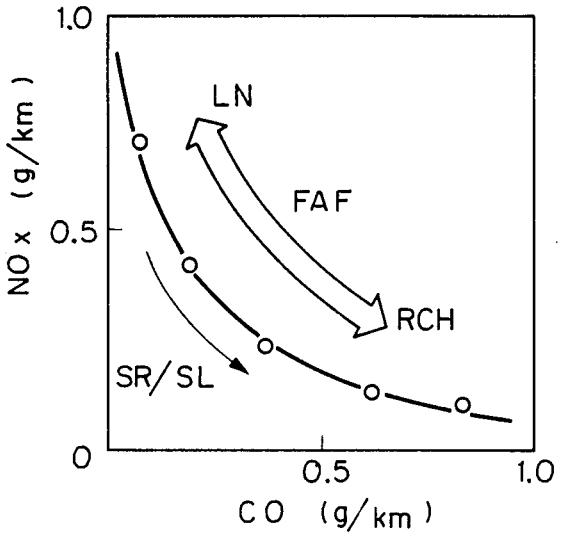

Further, as shown in FIG. 15D, if the rich skip amount SR is decreased (if the lean skip amount SL is increased), the air-fuel ratio correction amount FAF is decreased so that the controlled air-fuel ratio A/F is moved to the lean side, thus increasing the $NO_x$ emission. Contrary to this, if the rich skip amount SR is increased (if the lean skip amount SL is decreased), the air-fuel ratio correction amount FAF is increased so that the controlled air-fuel ratio A/F is moved to the rich side, thus reducing the $NO_x$ emission.

Thus, the air-fuel ratio during the air-fuel ratio feedback control is voluntarily controlled by changing at least one of the feedback control constants (parameters) RL, DR, DL, KR, KL, SR, and SL. Therefore, it is possible to reduce the $NO_x$ emission by changing at least one of the feedback control constants in accordance with the degree of functional deterioration of the air-fuel ratio sensor, since the $NO_x$ emission is conventionally increased due to this deterioration of the air-fuel ratio sensor. In addition, it is considered that the functioning of the air-fuel ratio sensor 5 is excessively deteriorated, i.e., completely deteriorated, when the changed air-fuel ratio feedback control constant reaches a predetermined value. In this case, an alarm is generated, and accordingly, the driver can replace the air-fuel ratio sensor with a new element.

Next, the fuel injection operation will be explained with reference to FIGS. 16 and 17.

Figure 16:
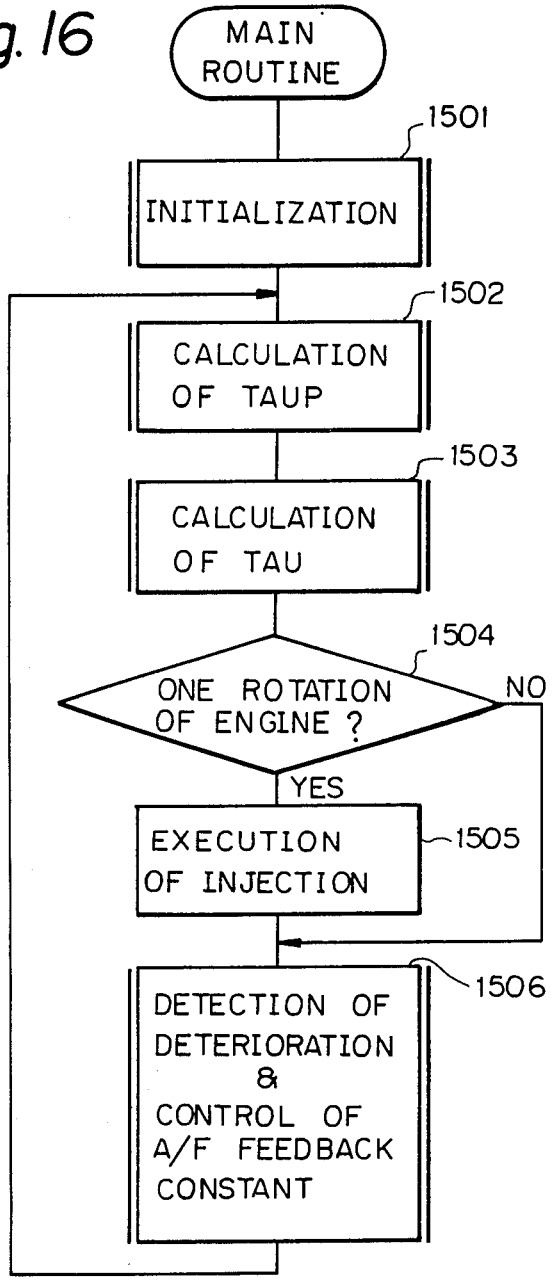

FIG. 16 is a main routine for carrying out fuel injection, started by turning on the ignition switch (not shown). At step 1501, the memories, the input ports, the output ports, and the like are initialized. At step 1502, a base fuel injection amount TAUP is calculated from data Q of the intake air amount and data N of the engine rotational speed. At step 1503, the base fuel injection amount TAUP is corrected by feedback control using the signal from the air-fuel ratio sensor 5 to realize a constant air-fuel ratio. That is, the fuel injection amount TAU is calculated by $$TAU \leftarrow TAUP \cdot FAF \cdot \alpha + \beta$$

where $\alpha$ and $\beta$ are constants.

At step 1504, it is determined whether or not one rotation of the engine 1 is detected. As a result, at every one rotation of the engine 1, the program flow advances to step 1505, in which the calculated opening period TAU is set in the output counter 110 (FIG. 3) thereby carrying out a fuel injection.

At step 1506, the degree of functional deterioration of the air-fuel ratio sensor 5 is detected, and the air-fuel ratio feedback control constant is changed in accordance with the detected degree of deterioration of the air-fuel ratio sensor 5.

Then, the control returns to step 1502.

The step 1506 of FIG. 16 will be explained in more detail with reference to FIG. 17. At step 1601, it is determined whether or not all the feedback conditions are satisfied in the same way as in step 1201 of FIG. 13, and at step 1602, it is determined whether all the learning conditions are satisfied. Note that the learning conditions are predetermined. Only when all the feedback conditions and all the learning conditions are satisfied, does the control proceed to step 1603. Otherwise the control proceeds to step 1615 which clears a counter N (N=0). Note that the learning conditions are as follows:

(i) the coolant temperature is higher than a definite value such as 60° C.;
(ii) the engine is in a steady state;
(iii) the throttle valve is not completely closed; and
(iv) the vehicle speed is higher than a definite value such as 20 Km/h. Of course, other learning conditions are introduced as occasion demands.

At step 1603, it is determined whether or not 32 ms has passed. That is, the flow of steps 1604 and thereafter is carried out at every 32 ms.

At step 1604, the counter N is counted by 1. Then at step 1605, the output voltage OX of the air-fuel ratio sensor 5 is fetched, and at step 1606, the value OX is stored in the memory 0(N) (N=1 to 200) of the RAM 108.

At step 1607, it is determined whether or not N=200. If N<200, the control proceeds directly to step 1616, while N =200, the control proceeds to step 1608.

At step 1608, a mean value MRS of the positive differential waveform (rich slope) is calculated on the basis of the data 0(1) to 0(200). That is, $\Delta$0(i) is calculated by $$\Delta O(=I) = O(i+1) - O(i)$$

where i=1 to 199. Then, a mean value MRS of the positive values of 0(i) (i=1 to 199) is calculated.

Then, at step 1609, it is determined whether or not the mean value MRS of the positive differential values is larger than or equal to a predetermined value $MRS_0$. If $MRS > MRS_0$ so that the functioning of the air-fuel ratio sensor 5 is normal, the control proceeds to step 1614 which clears the counter N(N=0). Contrary to this, where $MRS \leqq MRS_0$ and the functioning of the air-fuel ratio sensor 5 is deteriorated, the control proceeds to step 1610.

At step 1610, the reference voltage RL is increased by $$RL \leftarrow RL + \Delta RL$$

where $\Delta RL = k_1(MRS_0 - MRS)$ and $k_1$ is a constant. That is, since term $(MRS_0 - MRS)$ represents the degree of functional deterioration of the air-fuel ratio sensor 5, the reference voltage RL is increased in accordance with this degree of deterioration of the air-fuel ratio sensor 5. Note that the increase of the reference voltage RL incurs the reduction of the $NO_x$ emission as explained above.

At step 1611, it is determined whether or not the increased reference voltage RL exceeds a predetermined maximum limit MAXRL. As a result, if RL≦MAXRL, the control proceeds to step 1614. If RL>MAXRL, the control proceeds to step 1612 which replaces RL with MAXRL, and further proceeds to step 1613 which sets an alarm flag SBAD. In this case, the alarm flag SBAD (="1") means that the functioning of the air-fuel ratio sensor 5 is completely deteriorated, and the alarm flag SBAD is transmitted to the output port 104 (FIG. 2) thereby turning on the alarm 9. The routine of FIG. 17 is completed by step 1616.

Figures 17, 17A:
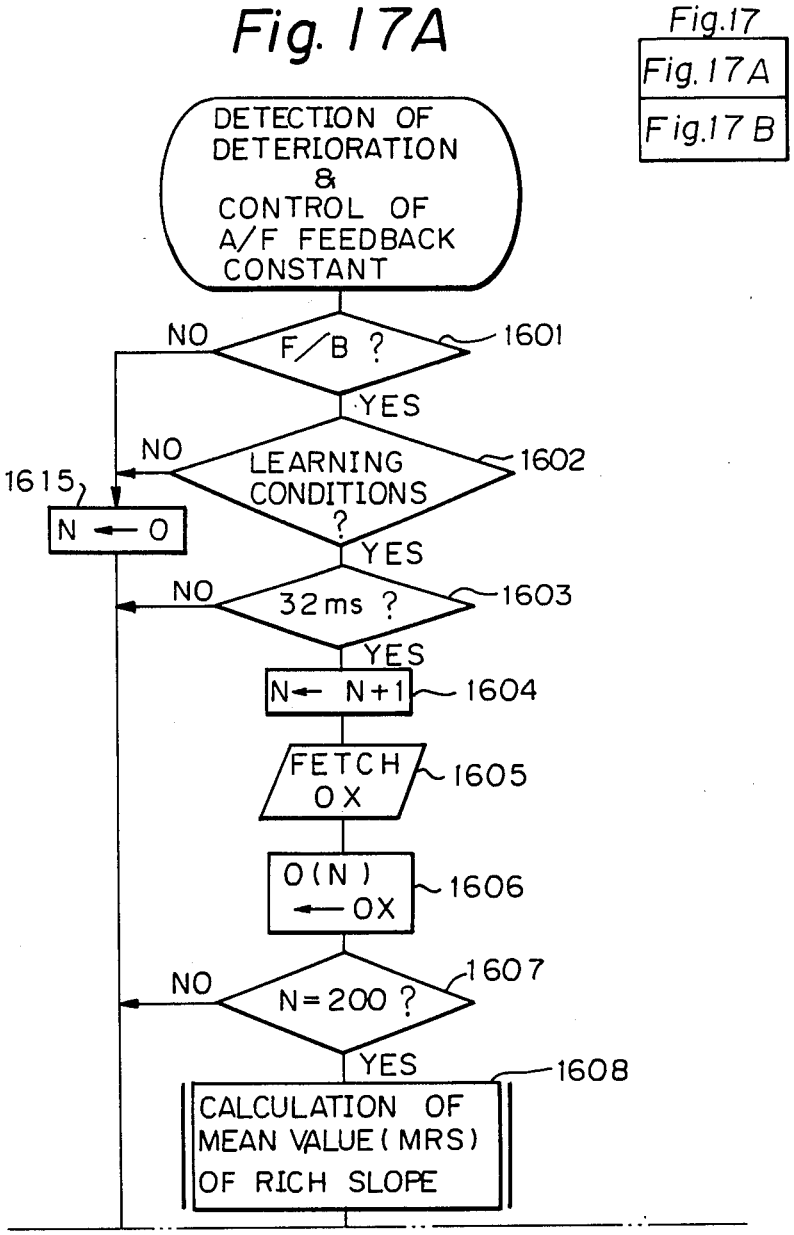
Figure 17B:
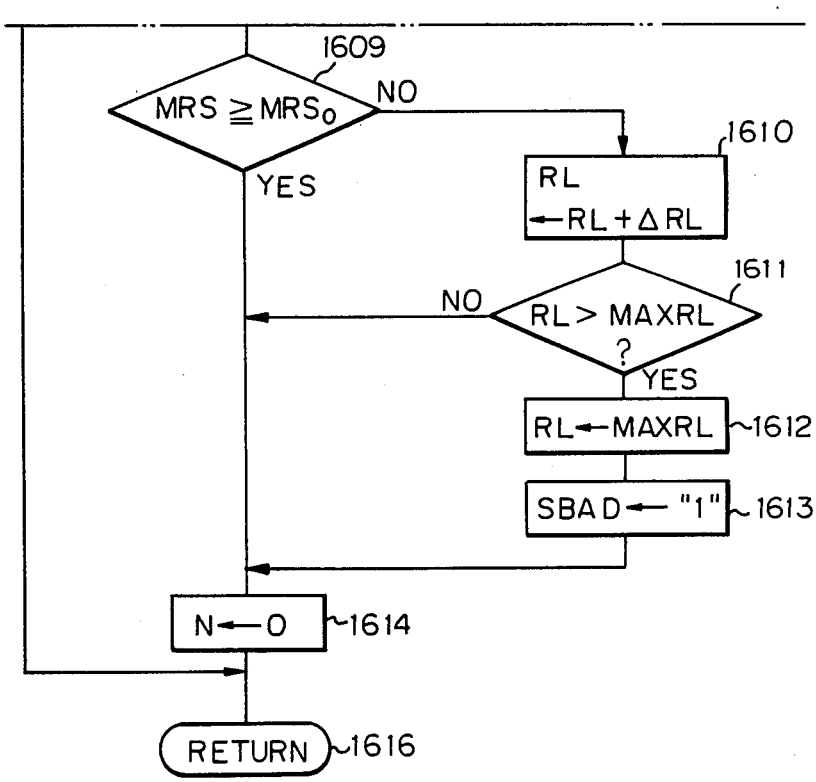

Modifications of steps 1608 and 1609 of FIG. 17 are possible as shown in FIGS. 18A, 18B, 18C, 18D, and 18E.

Figure 18A:
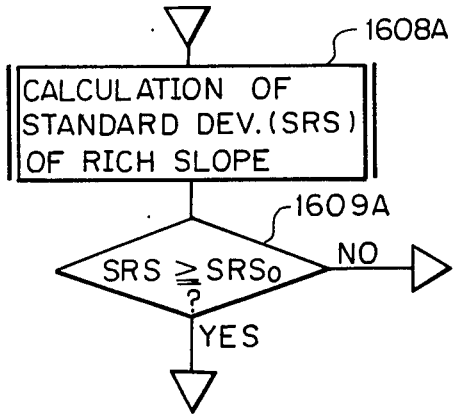

In FIG. 18A, at step 1608A, a standard deviation SRS of the positive differential waveform (rich slope) is calculated on the basis of the data 0(1) to 0(200). That is, 0(i) is calculated by $$\Delta O(i)=O(i+1)-O(i)$$

where i=1 to 199. Then a standard deviation SRS of the positive values of ΔO(i) (i=1 to 199) is calculated.

Then, at step 1609A, it is determined whether or not the standard deviation SRS of the positive differential values is larger than or equal to a predetermined value $SRS_0$. If $SRS \geqq SRS_0$, the functioning of the air-fuel ratio sensor 5 is normal. Contrary to this, $SRS < SRS_0$, the functioning of the air-fuel ratio sensor 5 is deteriorated.

Figure 18B:
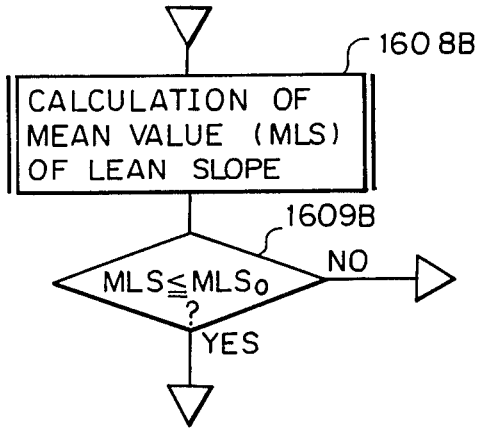

In FIG. 18B, at step 1608B, a mean value MLS of the negative differential waveform (lean slope) is calculated on the basis of the data 0(1) to 0(200). That is, 0(i) is calculated by $$\Delta O(i)=O(i+1)-O(i)$$

wherein i=1 to 199. Then a mean value MLS of the negative values of ΔO(i) (i=1 to 199) is calculated.

Then, at step 1609B, it is determined whether or not the mean value MLS of the negative differential values is smaller than or equal to a predetermined value $MLS_0$. If $MLS \leqq MLS_0$, functioning of the air-fuel ratio sensor 5 is normal. Contrary to this, $MLS > MLS_0$, the functioning of the air-fuel ratio sensor 5 is deteriorated.

Figure 18C:
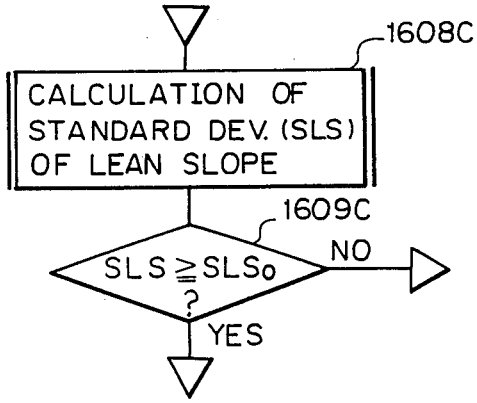

In FIG. 18C, at step 1608C, a standard deviation SLS of the negative differential waveform (lean slope) is calculated on the basis of the data 0(1) to 0(200). That is, ΔO(i) is calculated by $$\Delta O(i)=O(i+1)-O(i)$$

wherein i=1 to 199. Then, a standard deviation SLS of the negative values of Δ0(i) (i=1 to 199) is calculated.

Then, at step 1609C, it is determined whether or not the standard deviation SLS of the negative differential values is larger than or equal to a predetermined value SLS. If $SLS \geqq SLS_0$, functioning of the air-fuel ratio sensor 5 is normal. Contrary to this, $SLS < SLS_0$, the functioning of the air-fuel ratio sensor 5 is deteriorated.

Figure 18D:
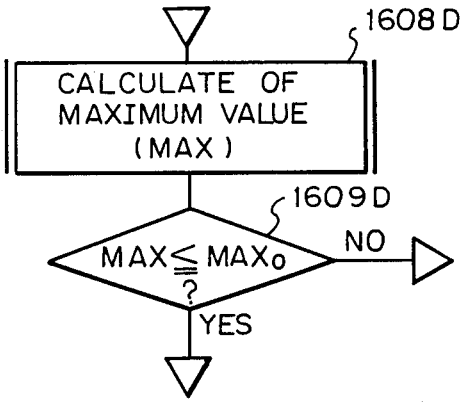

In FIG. 18D, at step 1608D, a maximum value (MAX) of the differential waveform is calculated on the basis of the data 0(1) to 0(200). Then, at step 1609D, it is determined whether or not the maximum value MAX is larger than or equal to a predetermined value MAX. If $MAX \geqq MAX_0$, functioning of the air-fuel ratio sensor 5 is normal. Contrary to this, $MAX < MAX_0$, the functioning of the air-fuel ratio sensor 5 is deteriorated.

Figure 18E:
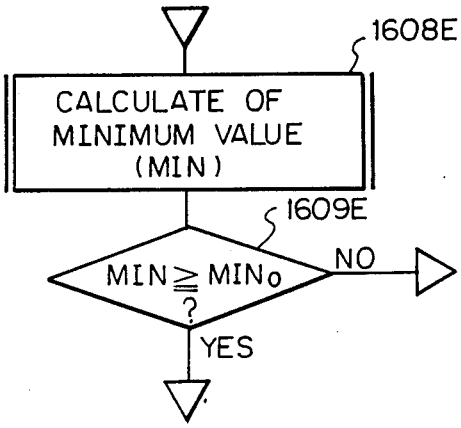

In FIG. 18E, at step 1608E, a minimum value (MIN) of the differential waveform is calculated on the basis of the data 0(1) to 0(200). Then, at step 1609E, it is determined whether or not the minimum value MIN is smaller than or equal to a predetermined value SLS. If $MIN \geqq MIN_0$, functioning of the air-fuel ratio sensor 5 is normal. Contrary to this, $MIN < MIN_0$, the functioning of the air-fuel ratio sensor 5 is deteriorated.

Modifications of steps 1610 through 1612 are possible as shown in FIGS. 19A through 19F.

Figure 19A:
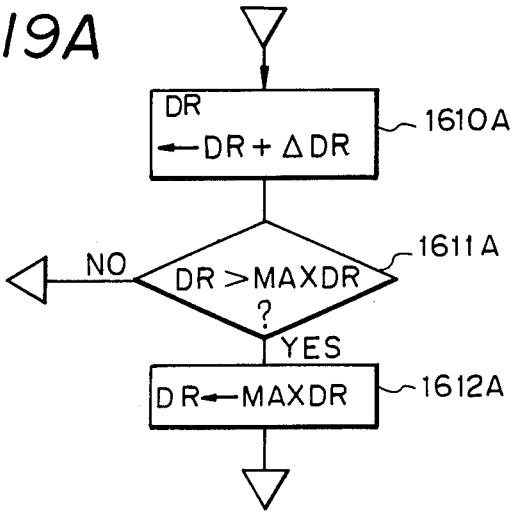

In FIG. 19A, at step 1610A, the rich delay time period DR is increased by $$DR \leftarrow DR + \Delta DR$$

where $\Delta DR = k_2(MRS_0 - MRS)$ and $k_2$ is a constant. That is, the rich delay time period DR is increased in accordance with the degree of deterioration of the air-fuel ratio sensor 5. Note that the increase of the rich delay time period DR incurs the reduction of the $NO_x$ emission as explained above.

At step 1611A, it is determined whether or not the increased rich delay time period DR exceeds a predetermined maximum limit MAXDR. As a result, if $DR \leqq MAXIDR$, the control proceeds to step 1614. If $DR > MAXDR$, the control proceeds to step 1612A which replaces DR with MAXDR.

Figure 19B:
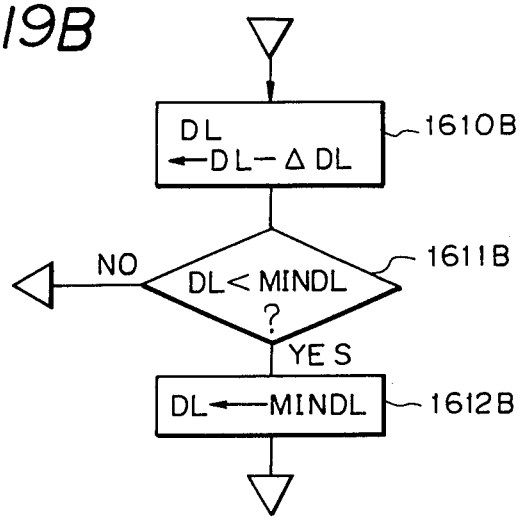

In FIG. 19B, at step 1610B, the lean delay time period DL is decreased by $$DL \leftarrow DL - \Delta DL$$

where $\Delta DL = k_3(MRS_0 - MRS)$ and $k_3$ is a constant. That is, the lean delay time period DL is decreased in accordance with the degree of functional deterioration of the air-fuel ratio sensor 5. Note that the decrease of the lean delay time period DL incurs the reduction of the $NO_x$ emission as explained above.

At step 1611B, it is determined whether or not the decreased lean delay time period DL becomes lower than a predetermined minimum limit MINDL. As a result, if $DL \geqq MINDL$, the control proceeds to step 1614. If $DL < MINDL$, the control proceeds to step 1612B which replaces DL with MINDL.

Figure 19C:
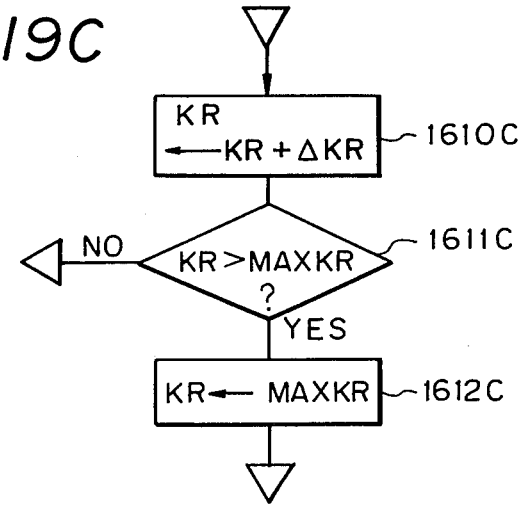

Note that the modifications of FIGS. 18A and 18B can be simultaneously carried out. In this case, the value DR/DL affects the air-fuel ratio correction amount FAF. In FIG. 19C, at step 1610C, the rich integration amount KR is increased by $$KR \leftarrow KR + \Delta KR$$

where $\Delta KR = k_4(MRS_0 - MRS)$ and $k_5$ is a constant. That is, the rich integration amount KR is increased in accordance with the degree of functional deterioration of the air-fuel ratio sensor 5. Note that the increase of the rich integration amount KR incurs the reduction of the $NO_x$ emission as explained above, At step 1611C, it is determined whether or not the increased rich integration amount KR exceeds a predetermined maximum limit MAXKR. As a result, if $KR \leqq MAXKR$, the control proceeds to step 1614. If $KR > MAXKR$, the control proceeds to step 1612C which replaces KR with MAXKR.

Figure 19D:
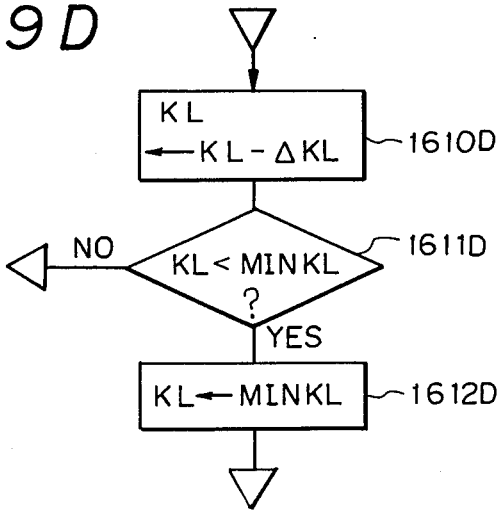

In FIG. 19D, at step 1610D, the lean integration amount KL is decreased by $$KL \leftarrow KL + \Delta KL$$

where $\Delta KL = k_5(MRS_0 - MRS)$ and $k_5$ is a constant. That is, the lean integration amount KL is decreased in accordance with the degree of functional deterioration of the air-fuel ratio sensor 5. Note that the decrease of the lean integration amount KL incurs the reduction of the $NO_x$ emission as explained above.

At step 1611D, it is determined whether or not the decreased lean integration amount KL becomes lower than a predetermined minimum limit MINKL. As a result, if $KL \geqq MINKL$, the control proceeds to step 1614. If $KL < MINKL$, the control proceeds to step 1612D which replaces KL with MINKL.

Note that the modifications of FIGS. 18C and 18D can be simultaneously carried out. In this case, the value KR/KL affects the air-fuel ratio correction amount FAF.

Figure 19E:
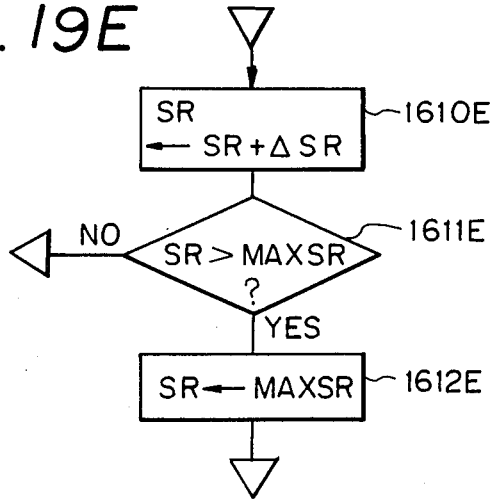

In FIG. 19E, at step 1610E, the rich skip amount SR is increased by $$SR \leftarrow SR + \Delta SR$$

where $\Delta SR = k_6(MRS_0 - MRS)$ and $k_6$ is a constant. That is, the rich skip amount SR is increased in accordance with the degree of functional deterioration of the air-fuel ratio sensor 5. Note that the increase of the rich skip amount SR incurs the reduction of the $NO_x$ emission as explained above.

At step 1611E, it is determined whether or not the increased rich skip amount SR exceeds a predetermined maximum limit MAXSR. As a result, if $SR \leqq MAXSR$, the control proceeds to step 1614. If $SR > MAXSR$, the control proceeds to step 1612E which replaces SR with MAXSR.

Figure 19F:
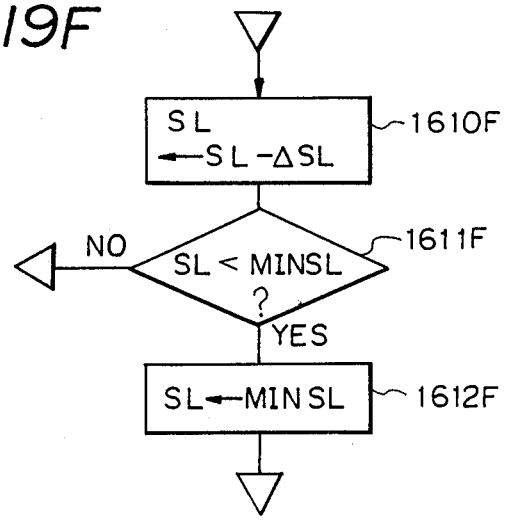

In FIG. 19F, at step 1610F, the lean skip amount SL is decreased by $$SL \leftarrow SL + \Delta SL$$

where $\Delta SL = k_7(MRS_0 - MRS)$ and $k_7$ is a constant. That is, the lean skip amount SL is decreased in accordance with the degree of function deterioration of the air-fuel ratio sensor 5. Note that the decrease of the lean skip amount SL incurs the reduction of the $NO_x$ emission as explained above.

At step 1611F, it is determined whether or not the decreased lean skip amount SL becomes lower than a predetermined minimum limit MINSL. As a result, if $SL \geqq MINSL$, the control proceeds to step 1614. If $SL < MINSL$, the control proceeds to step 1612F which replaces SL with MINSL.

Note that the modifications of FIGS. 19E and 19F can be simultaneously carried out. In this case, the value SR/SL affects the air-fuel ratio correction amount FAF.

Note that although the above-mentioned embodiment relates to an internal combustion engine for controlling the fuel injection amount by fuel injection valves, the present invention can be applied to an internal combustion engine having a carburetor. In addition, it is possible to detect the degree of functional deterioration of the air-fuel ratio sensor by two or more than two of the characteristic values obtained from the differential values of the output signal of the air-fuel ratio sensor. Further, when a functional deterioration is detected in the air-fuel ratio sensor, any two or more feedback control constants can be simultaneously changed to reduce the $NO_x$ emission.

We claim:

1. An apparatus for controlling the air-fuel ratio in an internal combustion engine having an exhaust pipe, comprising:

air-fuel ratio sensor means, provided in said exhaust pipe, for sensing a concentration of a specific component of the exhaust gas of said engine and providing an output signal corresponding thereto; and control means for (a) determining whether or not the output signal of said air-fuel ratio sensor means is larger than a reference voltage, (b) calculating a differential waveform of said output signal with respect to time, (c) detecting a degree of functional deterioration of said air-fuel ratio sensor means by using successive measurements of said differential waveform of said output signal over a predetermined period of time, (d) controlling an air fuel ratio feedback control value in accordance with the detected degree of functional deterioration of said air-fuel ratio sensor means, (e) calculating an air-fuel ratio correction amount in accordance with the reference voltage determination of the output signal of said air-fuel ratio sensor means and said air-fuel ratio feedback control value, and (f) adjusting an amount of fuel to be supplied to said engine in accordance with said calculated air-fuel ratio correction amount so that the air-fuel ratio of said engine approaches a predetermined value.

2. An apparatus as set forth in claim 1, wherein said control means (cl) calculates a mean value of a positive component (rich slope) of the differential waveform of the output signal, and (c2) determines whether or not the mean value of the positive component of the differential waveform is larger than a predetermined value.

3. An apparatus as set forth in claim 1, wherein said control means (cl) calculates a standard deviation of a positive component of the differential waveform of the output signal, and (c2) determine whether or not the standard deviation of the positive component of the differential waveform is larger than a predetermined value.

4. An apparatus as set forth in claim 1, wherein said control means (cl) calculates a maximum value of the differential waveform of the output signal, and (c2) determines whether or not the maximum value of the differential waveform is smaller than a predetermined value.

5. An apparatus as set forth in claim 1, wherein said control means (cl) calculates a mean value of a negative component (lean slope) of the differential waveform of the output signal, and (c2) determines whether or not a mean value of the negative component of the differential waveform is smaller than a predetermined value.

6. An apparatus as set forth in claim 1, wherein said control means (cl) calculates a standard deviation of a negative component (lean slope) of the differential waveform of the output signal, and (c2) determine whether or not a mean value of the negative component of the differential waveform is larger than a predetermined value.

7. An apparatus as set forth in claim 1, wherein said control means (cl) calculates a minimum value of the differential waveform of the output signal, and (c2) determines whether or not the minimum value of the differential waveform is larger than a predetermined value.

8. An apparatus as set forth in claim 1, wherein said control means (d1) increases said reference voltage in accordance with the detected degree of functional deterioration of said air-fuel ratio sensor means.

9. An apparatus as set forth in claim 1 wherein said control means (g) delays the reference voltage determination of the output signal of said air-fuel ratio sensor means by a rich delay time period when the reference voltage determination of the output signal of said air-fuel ratio sensor means is changed from a lean side to a rich side, and (h) delays the reference voltage determination of the output signal of said air-fuel ratio sensor means by a lean delay time period when the reference voltage determination of the output signal of said air-fuel ratio sensor means is changed from the rich side to the lean side.

10. An apparatus as set forth in claim 9, wherein said control means increases said rich delay time period in accordance with the detected degree of functional deterioration of said air-fuel ratio sensor means.

11. An apparatus as set forth in claim 9, wherein said control means decreases said lean delay time period in accordance with the detected degree of functional deterioration of said air-fuel ratio sensor means.

12. An apparatus as set forth in claim 9, wherein said control means increases said rich delay time period and decreases said lean delay time period in accordance with the detected degree of functional deterioration of said air-fuel ratio sensor means.

13. An apparatus as set forth in claim 1, wherein said control means (g) gradually increases said air-fuel ratio correction amount by a rich integration amount when the output signal of said air-fuel ratio sensor means is determined to be below said reference voltage, and (h) gradually decreases said air-fuel ratio correction amount by a lean integration amount when the output signal of said air-fuel ratio sensor means is determined to be above said reference voltage.

14. An apparatus as set forth in claim 13, wherein said control means increases said rich integration amount in accordance with the detected degree of functional deterioration of said air-fuel ratio sensor means.

15. An apparatus as set forth in claim 13, wherein said control means decreases said lean integration amount in accordance with the detected degree of functional deterioration of said air-fuel ratio sensor means.

16. An apparatus as set forth in claim 13, wherein said control means increases said rich integration amount and decreases said lean integration amount in accordance with the detected degree of functional deterioration of said air-fuel ratio sensor means.

17. An apparatus as set forth in claim 1, wherein said control means (g) greatly increases said air-fuel ratio correction amount by a rich skip amount when the reference voltage determination of the output signal of said air-fuel ratio sensor means changes from, being above said reference voltage to being below said reference voltage and (h) greatly decreases said air-fuel ratio correction amount by a lean skip amount when the reference voltage determination of the output signal of said air-fuel ratio sensor means is changed from being below said reference voltage to being above said reference voltage.

18. An apparatus as set forth in claim 17, wherein said control means increases said rich skip amount in accordance with the detected degree of functional deterioration of said air-fuel ratio sensor means.

19. An apparatus as set forth in claim 17, wherein said control means decreases said lean skip amount in accordance with detected degree of functional deterioration of said air-fuel ratio sensor means.

20. An apparatus as set forth in claim 17, wherein said control means increases said rich skip amount and decreases said lean skip amount in accordance with the detected degree of functional deterioration of said air-fuel ratio sensor means.

21. An apparatus as set forth in claim 1 wherein said control means (g) determines whether or not the controlled air-fuel ratio feedback control value reaches a limit value, and (h) generates an alarm when the controlled air-fuel ratio feedback control value reaches said limit value.

* * * * *